United States Patent [19]

Watanabe et al.

[11] 3,956,160

[45] May 11, 1976

[54] HEAVY DUTY DETERGENT POWDER AND PROCESS FOR PRODUCTION OF THE SAME

[75] Inventors: Yutaka Watanabe; Hiroshi Ueno, both of Kyoto, Japan

[73] Assignee: Dai-Ichi Kogyo Seiyaku Co., Ltd., Kyoto, Japan

[22] Filed: Dec. 12, 1973

[21] Appl. No.: 424,028

[30] Foreign Application Priority Data

Dec. 12, 1972 Japan ..... 47-124592

[52] U.S. Cl. ..... 252/132; 252/108; 252/367; 252/368; 252/369; 252/370

[51] Int. Cl.[2] ..... C11D 9/02; C11D 9/12; C11D 10/04; C11D 13/20

[58] Field of Search ..... 252/108, 132, 367, 368, 252/369, 370

[56] References Cited

UNITED STATES PATENTS

| | | | |
|---|---|---|---|
| 2,730,507 | 1/1956 | Bradford | 252/369 |
| 3,216,946 | 11/1965 | Curtin | 252/108 X |
| 3,814,692 | 6/1974 | Mostow | 252/108 |

*Primary Examiner*—Dennis L. Albrecht

*Attorney, Agent, or Firm*—Sughrue, Rothwell, Mion, Zinn and Macpeak

[57] ABSTRACT

A heavy duty detergent powder and a process for producing the heavy duty detergent powder which comprises neutralizing a fatty acid having, optionally, dissolved therein at least one nonionic surface active agent with a powdered hydrous sodium carbonate at a temperature higher than the melting point of the fatty acid are disclosed.

11 Claims, No Drawings

HEAVY DUTY DETERGENT POWDER AND PROCESS FOR PRODUCTION OF THE SAME

BACKGROUND OF THE INVENTION

1. Field of the Invention

This invention relates to a heavy duty detergent powder comprising predominantly soap and an improved process for producing the same. More particularly, this invention relates to a heavy duty detergent powder in the form of relatively coarse particles of soap having a low moisture content which can easily be disintegrated and an improved process for producing such a detergent powder in a single step which comprises neutralizing a fatty acid having, optionally, dissolved therein at least one nonionic surface active agent with a powdered hydrous sodium carbonate at a temperature higher than the melting point of the fatty acid used.

2. Description of the Prior Art

The laundry soap powders commercially available at present generally comprise 45 to 55 % by weight of soap, 25 to 35 % by weight of soda ash, 0 to 10% by weight of sodium sulfate and 15 to 25 % by weight of water, and are prepared by a process comprising thoroughly mixing a soap paste with soda ash in a mill, allowing the resulting soap to stand in a solidification frame to solidify the mixture, cutting the soap to produce soap bars, and crushing or disintegrating the soap bars with a crusher or a disintegrator to obtain a soap powder. The above-described conventional process involves a number of cumbersome steps and requires a prolonged processing time and much labor. Further, the product obtained from such a conventional process has various problems which remain unsolved, for example, the product generally exhibits poor flowability and tends to cake.

Soap is an excellent detergent because of its non-toxicity and high biodegradability and thus it can be safely used without the possibility of environmental pollution, but it possesses a serious disadvantage for household use in that the detergency of soap is drastically lowered at low temperatures and that a metal soap formed by reaction of the soap and the metal ions contained in water tends to be deposited on laundry, such as textiles, thereby hardening the texture of fibers. These disadvantages can be eliminated by incorporating 10 to 20% by weight of nonionic surface active agents, etc. into pure soap, but the solid mass of such mixtures generally tends to be softened and becomes tacky. Thus, disintegration of the solid mass into fine particles is difficult resulting in poor water-solubility and caking is easily caused.

SUMMARY OF THE INVENTION

A primary object of this invention is to provide an improved process for conveniently and easily producing a heavy duty detergent powder, which optionally contains at least one non-ionic surface active agent, having an improved flowability and an anti-caking property which eliminates the above-described disadvantages associated with the conventional product.

Another object of this invention is to provide a heavy duty detergent powder containing, optionally, at least one nonionic surface active agent having an improved flowability and an anti-caking property.

The above objects can be accomplished by a process comprising mixing a fatty acid having, optionally, dissolved therein at least one non-ionic surface active agent with a powdered hydrous sodium carbonate in an amount higher than two times the neutralization equivalent, i.e., more than 1 mole of a powdered hydrous sodium carbonate per 1 mole of the fatty acid, at a temperature higher than the melting point of the fatty acid used thereby producing coarse particles of soap having a low moisture content in a single step. The resulting coarse particles of soap produced by the above process can easily be disintegrated into a detergent powder.

DETAILED DESCRIPTION OF THE INVENTION

The characteristic features of the present invention over the conventional process for producing a soap powder include the following.

1. Solidification, cutting and disintegrating steps can be eliminated thereby drastically reducing the production time required the labor necessary and the space requirements for plant installation.

2. Products having an excellent flowability due to their low water content and an excellent anti-caking property can be obtained.

3. Products having a high soap content (about 66 to 77% by weight of soap) can easily be obtained. The maximum soap content in the products obtained using the conventional process is generally about 50% by weight and, in order to increase the soap content higher than about 50%, a drying step should be included in the process.

4. Heavy duty detergent powders of high quality comprising predominantly soap can easily be obtained using a simple procedure even if non-ionic surface active agents are incorporated in a proportion required for improving the performance of the soap (about 10 to 20% by weight based on the pure soap) since the the process conditions employed in this invention do not adversely affect the flowability and the anit-caking property of the resulting powder.

As set forth previously, the process for this invention comprises mixing a fatty acid, or a mixture thereof, and optionally non-ionic surface active agents with powdered hydrous sodium carbonate.

Suitable fatty acids which can used in the present invention can be any type of fatty acids or a mixture of fatty acids of fats and oils from either vegetable and/or animal origin commonly employed in the production of the conventional soaps. Typical examples of such fatty acids are beef tallow (melting point, 45°–48°C), coconut oil (melting point, 20°–28°C), cotton seed oil (melting point (titer), 30°–37°C), palm oil (melting point, 30°–50°C), palm kernel oil (melting point, 25°–30°C), soybean oil (melting point (titer), 22°–27°C) and a mixture thereof.

The powdered sodium carbonate usually includes $Na_2CO_3$ (anhydrous), $Na_2CO_3.H_2O$ (monohydrate), $Na_2CO_3.10H_2O$ (decahydrate), etc. $Na_2CO_3.10H_2O$ (moisture content, about 63% by weight) is generally not suitable for use in the present invention because of its high moisture content. On the other hand, $Na_2CO_3$ (moisture content, lower than 1% by weight) cannot advantageously be used in the present invention since an unduly prolonged period of time is generally required to complete the reaction with the fatty acids and, in addition, complete neutralization of fatty acids is difficult. A suitable moisture content for the hydrous sodium carbonate used in this invention can range from about 5 to 20%, preferably 10 to 15%, by weight. Any of the anhydrous or hydrated formed can be used as long as their moisture contents are within this range or adjusted to within this range. Thus, $Na_2CO_3.H_2O$ (moisture content, about 15% by weight) can be used advantageously in the present invention since it provides a rapid neutralization reaction and with this material the complete neutralization is easy. It is, of course, possible to use the sodium carbonate obtained by adjusting the moisture content of anhydrous sodium carbonate to a range of from about 5% to about 20% by weight, with a comparable result as that obtained using $Na_2CO_3.H_2O$. If desired, sodium sesquicarbonate, i.e., $Na_2CO_3.NaHCO_3.2H_2O$ (moisture content, 16% by weight), can also be used in the present invention in place of all or a part of the hydrous sodium carbonate with a comparable result, but, generally, the use of sodium sesquicarbonate does not result in any advantages from an industrial standpoint since it is expensive as compared with sodium carbonate and no additional advantages can be realized with sodium sesquicarbonate.

The theoretical neutralization equivalent between the fatty acid and sodium carbonate is 0.5 mol of sodium carbonate per 1 mole of fatty acid. However, in order to ensure complete neutralization using powdered hydrous sodium carbonate, it is generally necessary to employ the sodium carbonate in a proportion greater than 1 mol, preferably about 1.5 moles per 1 mole of a fatty acid. It is to be noted, however, that though the amount of the powdered hydrous sodium carbonate is 1 to 1.5 moles to obtain the complete neutralization, a larger amount of the sodium carbonate can be used without any problem in the production of the desired heavy duty detergent powder. Rather, the amount of sodium carbonate can be increased according to the utility of the final detergent.

When hydrous sodium carbonate is used in an amount of 1 to 1.5 moles per 1 mole of a fatty acid, the final heavy duty detergent powder generally contains about 20% to about 30% carbonates (sodium bicarbonate and sodium carbonate) and such bicarbonate and carbonate effectively serve as a builder which is an essential component of detergents and does not adversely affect the performance of the detergent according to the present invention. It is also possible and sometimes preferred to increase the carbonate content (sodium bicarbonate and sodium carbonate) in the final product to on the order of about 40% by weight by incorporating an additional amount of hydrous sodium carbonate and/or anhydrous sodium carbonate. This can be effected by using an excess amount of hydrous powdered sodium carbonate in the neutralization step or by adding hydrous and/or anhydrous sodium carbonate to the neutralized product.

In the neutralization step, the neutralization reaction proceeds easily when powdered hydrous sodium carbonate is mixed with a fatty acid at a temperature higher than the melting point of the fatty acid used, but the mixture tends to become solid as the neutralization proceeds thereby making effective blending of the mixture difficult. Accordingly, in order to ensure a smooth reaction and at the same time to complete the neutralization reaction within a shorter period of time, it is preferred that the mixture be softened by heating at a temperature higher than about 80°C and that the mixture be effectively stirred.

The mixing of the fatty acid which can contain nonionic surface active agents and the powdered hydrous sodium carbonate can be effected in any manner which is well-known to one skilled in the art. That is, the powdered hydrous sodium carbonate can be incorporated into a molten fatty acid or vice versa. Alternatively, a molten fatty acid and a powdered hydrous sodium carbonate can be fed simultaneously into an appropriate kneader as hereinafter described in greater detail.

This mixing is effected while heating at a temperature higher than the melting point of the fatty acid used, preferably 80° to 100°C. The heating at a temperature higher than 100°C often causes excess foaming thereby resulting in products of porous and coarse particles which can easily be disintegrated, but it is generally not preferred to subject fatty acids to such high temperatures since the quality of the final product is deteriorated. Also, the mixing is desirably effected as rapidly as possible. For example, when powdered hydrous sodium carbonate is gradually incorporated into a molten fatty acid, the viscosity of the resulting mixture increases as the amount of the soap produced increases and the increased viscosity prevents a smooth and thorough mixing. Thus, a portion of the fatty acid tends to remain unreacted. Likewise, the same tendency as described above can be observed when a molten fatty acid is incorporated into a powdered hydrous sodium carbonate. Accordingly, in the production of the detergent on a large scale, it is preferred to react the molten fatty acid and a powdered hydrous sodium carbonate in a continuous manner while feeding them simultaneously in a predetermined proportion into a mixer at a constant rate. As described previously, powdered hydrous sodium carbonate is preferably fed rapidly and in one portion, but when an excess of powdered hydrous sodium carbonate which exceeds the amount required for neutralization is added, it need not necessarily be added entirely in one portion together with the amount required for neutralization and can be added portionwise after completion of the neutralization. The mixing is preferably conducted vigorously since such a strong mixing reduces the amount required for the complete neutralization and also reduces the time required for the neutralization reaction. The time required for the complete neutralization reaction after mixing the fatty acid and the powdered hydrous sodium carbonate is generally from about 20 seconds to about 60 seconds in a typical conventional kneader.

The coarse particles of soap obtained by mixing the fatty acid and the powdered hydrous sodium carbonate as described above can be used as a detergent after it is disintegrated, but, in order to improve the performance of the soap at low temperatures and the scum dispersibility, various additives such as those used in conventional detergents can be added to the soap, for example, non-ionic surface active agents, alkali builders such as sodium carbonate, sodium sesquicarbonate, sodium silicate, borax and the like, builders which form chelates with metal ions such as sodium tripolyphosphate, NTA, EDTA, sodium citrate and the like, and other additives such as carboxymethyl cellulose for preventing redeposition, bleaching agents, fluoreacent dyes, perfumes, etc. in an appropriate proportion to obtain more effective and attractive detergents. As is apparent to one skilled in the art, a portion of the alkali builders incorporated into the heavy duty detergent powder of this invention can be replaced by sodium sulfate which is generally used in conventional household detergents and which is cheaper than the alkali builders.

In incorporating non-ionic surface active agents in accordance with the present invention, it is necessary to dissolve the non-ionic surface active agents in the fatty acid prior to the neutralization reaction to ensure uniform distribution of the non-ionic surface active agents in the resulting detergent. The non-ionic surface active agents are usually present in an proportion of from about 3 to 30% by weight, preferably 10 to 20% by weight based on the total weight of the detergent. On the other hand, the builders are preferably added to the detergent after completion of the neutralization reaction but prior to the subsequent cooling.

The non-ionic surface active agents which can be used in the present invention can be any type of non-ionic agents, but preferably ester-type or ether-type non-ionic surface active agents having an HLB (Hydrophile-Lipophile Balance) of 10 to 16, preferably 12 to 14 are employed. Suitable examples of these non-ionic surface active agents, particularly from the standpoint of biodegradability and performance are sucrose fatty acid esters, higher alcohol ethoxylates, higher aliphatic acid polyxyethylene esters, higher aliphatic acid sorbitan ester ethylene oxide adducts and the like.

As is described in greater detail in the Examples, the mixing of the fatty acid or a mixture of the fatty acid and the non-ionic surface active agent and a powdered hydrous sodium carbonate is conveniently performed in a kneader thereby resulting in a coarse particle composition which is easily disintegrated. If desired, the resulting composition can further be disintegrated using disintegrator to obtain the desired heavy duty detergent powder.

In the following Examples, the caking ratio is determined using the following procedure:

A sample of the detergent powder is placed in a carton for detergents. The box is sealed and allowed to stand for a period of three months in a thermostatically controlled area at a temperature of 35°C and a relative humidity of 85%, At the end of this period, the carton is opened, and the content in the box is gently placed on a 4-mesh screen (Tyler Standard, the opening size is 4699 $\mu$). The amount of the detergent retained on the screen is weighed to determine the caking ratio using the equation:

$$\frac{\text{Wt. of Detergent Retained on Screen}}{\text{(Wt. of Detergent} - \text{(Wt. of Detergent Passed Through Screen) Retained on Screen)}} \times 100 = \text{Caking Ratio}$$

The present invention is further illustrated by the following examples, but these examples are not to be construed as limiting the scope of this invention. In the examples, parts and percents are by weight unless otherwise indicated.

EXAMPLE 1

71.0 parts of a beef tallow fatty acid were melted by heating in a kneader, and 33.0 parts of a powdered hydrous sodium carbonate (moisture content, 15%) were added to the molten fatty acid while maintaining the fatty acid at a temperature of 80 to 100°C with stirring. At the end of the addition of sodium carbonate the mixture was a soft paste and was subsequently turned into a dried lumpy material and, upon further continuing stirring, the material turned into coarse particles which were capable of being easily pulverized. The yield of the coarse particle soap thus obtained was found to be 100 parts, and the product was then allowed to cool and fed into a disintegrator to obtain a heavy duty detergent powder having excellent flowability and anticaking property. The analytical values and the caking ratio obtained were as follows:

| | |
|---|---|
| Soap Content | 76.8% |
| Carbonates ($Na_2CO_3$ and $NaHCO_3$) | 18.5% |
| Moisture Content | 4.7% |
| Total: | 100.0% |

Caking Ratio = 2%

EXAMPLE 2

46.2 parts of a beef tallow fatty acid were melted by heating in a kneader, and 31.5 parts of a powdered hydrous sodium carbonate (moisture content, 12%) were added to the molten fatty acid while maintaining the fatty acid at a temperature of 80 to 100°C with stirring. When the mixture turned into a dried lumpy material, 19.4 parts of anhydrous sodium carbonate and 6 parts of sodium sulfate were added to the mixture and the resulting mixture was mixed while disintegrating the lumpy material. The lumpy soap obtained above showed some stickiness at a high temperature before it is mixed with additional builders (anhydrous sodium carbonate and sodium sulfate), and these additional builders adhered to the surface of the lumpy soap to give ultimately uniform coarse particles. The yield of the coarse particle detergent thus obtained was 100 parts, and the product was then allowed to cool and fed into a disintegrator to obtain a heavy duty detergent powder having excellent flowability and anticaking property. The analytical values and the caking ratio obtained were as follows:

| | |
|---|---|
| Soap Content | 49.8% |
| Carbonates ($Na_2CO_3$ and $NaHCO_3$) | 39.6% |
| Sodium Sulfate | 5.9% |
| Moisture Content | 4.7% |
| Total: | 100.0% |

Caking Ratio = 5%

EXAMPLE 3

41.6 parts of a beef tallow fatty acid and 5.0 parts of Noigen ET-143 (trade name of a lauryl alcohol ethoxylate having $\bar{p}$ the average number of ethenoxy units of about 7, available from Dai-Ichi Kogyo Seiyaku Co., Ltd., Japan) were melted by heating in a kneader, and 28.4 parts of a powdered hydrous sodium carbonate (moisture content, 12%) were added to the molten mixture while maintaning the mixture at a temperature of 80° to 100°C with stirring. When the mixture turned into a dried lumpty material, 22.5 parts of anhydrous sodium carbonate and 5.5 parts of anhydrous sodium sulfate were added thereto followed by mixing while disintegrating the lumpy material to obtain 100 parts of coarse particles of detergent. After allowing the detergent to cool, the detergent was disintegrated using a disintegrator to give a heavy duty detergent powder having excellent flowability and anti-caking property. The analytical values and the caking ratio of the product obtained were as follows:

| | |
|---|---|
| Soap Content | 45.2% |
| Non-ionic Surface Active Agent | 4.9% |

-continued

| | |
|---|---|
| Carbonates ($Na_2CO_3$ and $NaHCO_3$) | 39.8% |
| Sodium Sulfate | 5.6% |
| Moisture Content | 4.5% |
| Total: | 100.0% |

Caking Ratio = 9%

EXAMPLE 4

26.5 parts of a beef tallow fatty acid, 6.0 parts of a conconut fatty acid and 4.0 parts of Noigen ET-143 (as described in Example 3) were melted by heating in kneader, and 34 parts of a powdered hydrous sodium carbonate (moisture content, 15%) were added to the molten mixture while maintaining the mixture at a temperature of 80° to 100°C with stirring. When the mixture turned into a dried lumpy material, 10 parts of sodium tripolyphosphate, 21 parts of sodium sulfate and 0.4 parts of a fluoresent dye were added thereto followed by mixing while disintegrating the lumpy material to obtain 100 parts of coarse particles of detergent. After allowing the detergent to cool, the detergent was disintegrated with a disintegrator to give a heavy duty detergent powder having excellent flowability and anti-caking property. The analytical values and the caking ratio of the product obtained were as follows:

| | |
|---|---|
| Soap Content | 35.8% |
| Non-Ionic Surface Active Agent | 4.0% |
| Sodium Tripolyphosphate | 10.2 |
| Carbonates ($Na_2CO_3$ and $NaHCO_3$) | 24.2% |
| Sodium Sulfate | 20.7% |
| Moisture Content | 5.1% |
| Total: | 100.0% |

Caking Ratio = 3%

EXAMPLE 5

26.5 parts of a beef tallow fatty acid, 6.0 parts of a hop oleic acid and 4.0 parts of DK Ester F-110 (trade name of an ester of sucrose and a hydrogenated beef tallow fatty acid having a degree of substitution, 1.50; monoester content, about 50%; di- and triester content, about 50%; available from Dai-Ichi Kogyo Seiyaku Co., Ltd., Japan) were melted by heating in a kneader, and 34 parts of a powdered hydrous sodium carbonate (moisture content, 15%) were added to the molten mixture while maintaining the mixture at a temperature of 80° to 100°C with stirring. when the mixture turned into a dried lumpy material, 10 parts of sodium tripolyphosphate, 21 parts of sodium sulfate and 0.4 parts of a fluorescent dye were added thereto followed by mixing while disintegrating the lumpy material to obtain 100 parts of coarse particles of detergent. After allowing the detergent to cool, the detergent was disintegrated using a disintegrator to give a heavy duty detergent powder having excellent flowability and anti-caking property. The analytical values and the caking ratio of the product obtained were as follows.

| | |
|---|---|
| Soap Content | 36.2% |
| Non-ionic Surface Active Agent | 3.6% |
| Sodium Tripolyphosphate | 10.2% |
| Carbonates ($Na_2CO_3$ and $NaHCO_3$) | 24.2% |
| Sodium Sulfate | 20.7% |
| Moisture Content | 5.1% |
| Total: | 100.0% |

Caking Ratio = 7%

EXAMPLE 6

26.5 parts of a beef tallow fatty acid, 6.0 parts of a conconut fatty acid and 4.0 parts of Noigen ES-140 (trade name of a coconut oil fatty acid polyoxyethylene ester, having $\bar{p}$ of about 9, available from Dai-Ichi Kogyo Seiyaku Co., Ltd., Japan) were melted by heating in a kneader, and 34 parts of a powdered hydrous sodium carbonate (moisture content, 15%) were added to the molten mixture while maintaining the mixture at a temperature of 80° to 100°C with stirring. When the mixture turned into a dried lumpy material, 10 parts of sodium tripolyphosphate, 21 parts of sodium sulfate and 0.4 parts of a fluorescent dye were added thereto followed by mixing while disintegrating the lumpy material to obtain 100 parts of coarse particles of detergent. After allowing the detergent to cool, the detergent was disintegrated using a disintegrator to give a heavy duty detergent powder having excellent flowability and anti-caking property. The analytical values and the caking ratio of the product obtained were as follows:

| | |
|---|---|
| Soap Content | 36.2% |
| Non-ionic Surface Active Agent | 3.6% |
| Sodium Tripolyphosphate | 10.2% |
| Carbonates ($Na_2CO_3$ and $NaHCO_3$) | 24.2% |
| Sodium Sulfate | 20.7% |
| Moisture Content | 5.1% |
| Total: | 100.0% |

Caking Ratio = 6%

EXAMPLE 7

26.5 parts of a beef tallow fatty acid, 6.0 parts of a coconut fatty acid and 4.0 parts of Sorgen TA-80 (trade name of an oleic acid sorbitan ester ethylene oxide adduct having a $\bar{p}$ of 20, available from Dai-Ichi Kogyo Seiyaku Co., Ltd., Japan) were melted by heating in a kneader, and 34 parts of a powdered hydrous sodium carbonate (moisture content, 15%) were added to the molten mixture while maintining the mixture at a temperature of 80° to 100°C with stirring. When the mixture turned into a dried lumpy material, 10 parts of sodium tripolyphosphate, 21 parts of sodium sulfate and 0.4 parts of a fluorescent dye were added thereto followed by mixing while disintegrating the lumpy mateiral to obtain 100 parts of coarse particles of detergent. After allowing the detergent to cool, the detergent was disintegrated using a disintegrator to give a heavy duty detergent powder having excellent flowability and anti-caking property. The analytical values and the caking ratio of the product obtained were as follows:

| | |
|---|---|
| Soap Content | 36.2% |
| Non-ionic Surface Active Agent | 3.6% |
| Sodium Tripolyphosphate | 10.2% |
| Carbonates ($Na_2CO_3$ and $NaHCO_3$) | 24.2% |
| Sodium Sulfate | 20.7% |
| Moisture Content | 5.1% |
| Total | 100.0% |

Caking Ratio = 7%

REFERENCE EXAMPLE 1

Into 64 parts of a soap paste (a beef tallow soap) having a moisture content of 29% charged in a kneader was added 5.0 parts of Noigen ET-143 (as described in Example 3) followed by 31 parts of anhydrous sodium carbonate. After thoroughly mixing, the mixture was allowed to stand in a solidification frame to obtain 100 parts of a solidified material. However, the material thus obtained exhibited a strong adhesiveness and could be crushed in a crusher but could not be disintegrated in a disintegrator. The analytical values and the caking ratio obtained were as follows:

| | |
|---|---|
| Soap Content | 45.2% |
| Non-ionic Surface Active Agent | 5.0% |
| Sodium Carbonate | 30.4% |
| Moisture Content | 19.4% |
| Total: | 100.0% |

Caking Ratio = 100% (completely caked)

REFERENCE EXAMPLE 2

The caking ratio was determined in the same manner as those described in the foregoing Examples with respect to a commercially available soap powder having the following analytical values. The caking ratio of this product was found to be 100.0% (completely caked).

| | |
|---|---|
| Soap Content | 45.2% |
| Sodium Carbonae | 30.7% |
| Sodium Sulfate | 5.0% |
| Moisture Content | 19.1% |
| Total: | 100.0% |

While the present invention has been desctibed in detail with reference to specific embodiments thereof, it is apparent to one skilled in the art that various changes and modifications can be made therein without departing from the scope and the spirit of the invention.

What is claimed is:

1. A process for producing a heavy duty detergent powder which comprises neutralizing a fatty acid with a powdered hydrous sodium carbonate which has a moisture content of from about 5 to 20% by weight at a temperature higher than the melting point of said fatty acid, said temperature ranging from about 80°C to 100°C; the amount of powdered hydrous sodium carbonate ranging from 1 to 1.5 moles per 1 mole of fatty acid; and said neutralizing being completed in a time period of from about 20 to about 60 seconds.

2. The process according to claim 1, wherein said fatty acid is derived from beef tallow, coconut oil, cotton seed oil, palm oil, palm kernel oil, soybean oil or a mixture thereof.

3. A heavy duty detergent powder obtained in accordance with the process of claim 1.

4. A process for producing a heavy duty detergent powder which comprises neutralizing a fatty acid having dissolved therein at least one non-ionic surface active agent with a powdered hydrous sodium carbonate which has a moisture content of from about 5 to 20% by weight at a temperature higher than the melting point of said fatty acid to prepare a soap, said temperature ranging from about 80°C to 100°C; said non-ionic surface active agent being present in an amount such that said non-ionic surface active agent comprises about 3 to 30% by weight based on the weight of the pure soap; the amount of powdered hydrous sodium carbonate ranging from 1 to 1.5 moles per 1 mole of fatty acid; and said neutralizing being completed in a time period of from about 20 about 60 seconds.

5. The process according to claim 4, wherein the amount of said nonionic surface active agent is 10 to 20% by weight.

6. The process according to claim 4, wherein said nonionic surface active agent is an ester type nonionic surface active agent or an ether type nonionic surface active agent having a hydrophilic-lipophilic balance (HLB) ranging from about 10 to 16.

7. The process according to claim 4, wherein said nonionic surface active agent is a sucrose aliphatic acid ester, a higher alcohol ethoxylate, a higher aliphatic polyoxy-ethylene ester or a higher aliphtic acid sorbitan ester ethylene oxide adduct.

8. The process according to claim 7, wherein said nonionic surface active agent is at least one agent selected from the group consisting of a lauryl alcohol ethoxylate, a sucrose hydrogenated beef tallow fatty acid ester, a coconut fatty acid polyoxyethylene ester and an oleic acid sorbitan esterethylene oxide adduct.

9. The process according to claim 4, wherein said neutralizing is by first dissolving said nonionic surface active agent in said fatty acid and then neutralizing the resulting mixture of said nonionic surface active agent and said fatty acid with a powdered hydrous sodium carbonate at a temperature higher than the melting point of said fatty acid.

10. The process according to claim 4, wherein said fatty acid is derived from beef tallow, coconut oil, cotton seed oil, palm oil, palm kernel oil, soybean oil or a mixture thereof.

11. A heavy duty detergent powder obtained in accordance with the process of claim 4.

* * * * *